United States Patent [19]

Ciucani et al.

[11] Patent Number: 4,703,532

[45] Date of Patent: Nov. 3, 1987

[54] PROCESS FOR STRETCHING THE VAMP OF MOCCASINS AND A DEVICE WITH WHICH TO IMPLEMENT THE PROCESS

[76] Inventor: Mario Ciucani, Fermo (Ascoli Piceno), Italy

[21] Appl. No.: 727,686

[22] Filed: Apr. 26, 1985

[30] Foreign Application Priority Data

Apr. 27, 1984 [IT] Italy ..... 3443 A/84

[51] Int. Cl.[4] ..... A43D 95/02; A43D 95/10

[52] U.S. Cl. ..... 12/53.5; 12/53.1; 12/54.2; 12/142 MC; 12/146 C

[58] Field of Search ..... 12/53.1, 53.2, 53.4, 12/53.5, 54.2, 8.1, 54.1, 53.3, 142 R, 146 C, 142 MC

[56] References Cited

U.S. PATENT DOCUMENTS

| | | | |
|---|---|---|---|
| 222,249 | 12/1879 | Crisp | 12/53.3 |
| 230,406 | 7/1880 | Crisp | 12/53.2 |
| 1,030,837 | 6/1912 | Ashton | 12/53.4 |
| 1,195,966 | 8/1916 | Brock | 12/146 C |
| 1,235,651 | 8/1917 | Brown | 12/54.2 |
| 1,914,442 | 6/1933 | Lawson | 12/54.3 |
| 2,095,245 | 12/1937 | Finn | 12/53.5 |
| 2,193,191 | 3/1940 | Dow et al. | 12/53.3 |

FOREIGN PATENT DOCUMENTS

| | | | |
|---|---|---|---|
| 3341487 | 5/1984 | Fed. Rep. of Germany | 12/142 MC |
| 1155159 | 4/1958 | France | 12/129.4 |
| 3892 | of 1876 | United Kingdom | 12/8.1 |
| 361755 | 11/1931 | United Kingdom | 12/53.1 |
| 460866 | 4/1975 | U.S.S.R. | 12/53.2 |
| 557788 | 6/1977 | U.S.S.R. | 12/53.2 |

*Primary Examiner*—Werner H. Schroeder
*Assistant Examiner*—Steven N. Meyers
*Attorney, Agent, or Firm*—Stevens, Davis, Miller & Mosher

[57] ABSTRACT

The process is defined by a cyclic succession of identical phases, through each of which the part of the skin subjected to stretching is gradually wound from one extremity to the other, and vice versa, by means of a continuous or discrete surface that exercises an adjustable pressure thereon.

A device with which the process can be carried out is constituted by a netted container, hung from a support, housing spherical objects and banded circumferentially with an elastic. The bottom end of the container is hooked to a wire that defines, in the said end, an adjustable depth lip.

With the said support given a top downward and vice versa movement, the bottom end of the container comes into contact with the vamp and then enshrouds this completely.

Consequently to the motion given to the support, the spherical objects that protrude from the meshes in the net come, first of all, into contact with the skin of the vamp and then roll over and/or rub, under pressure, against the said skin which is gradually stretched.

2 Claims, 5 Drawing Figures

H4
H2
F
A
1
1a
1b
2
3
3a
5
6
6a
7
8
9
10
11
20
20a
21
22
23

PROCESS FOR STRETCHING THE VAMP OF MOCCASINS AND A DEVICE WITH WHICH TO IMPLEMENT THE PROCESS

BACKGROUND OF THE INVENTION

The invention relates to a process for stretching the vamp of moccasins and to a device with which to implement the process.

DESCRIPTION OF THE PRIOR ART

As is known, the front sides of the vamp of moccasins (for example of the type known as 'tubular moccasins') have, once the toe cap has been sewn to the said vamp, ruffles and wrinkles that run crosswise and are flattened as much as possible (the optimal solution eliminates them) through the well known vamp stretching operation.

The said operation envisages the vamp being mounted on a suitable last heated (electrically or by means of a fluid circulating there inside) for the purpose of softening the skin, after which external action is taken on the ruffles and wrinkles in order to flatten them by stretching. The said action is in the form of striking the skin with suitable hammers operated either manually or by powered mechanical means.

Manual stretching leaves everything up to the ability of the operative (according to his experience) both as regards quality and speed. This particular method obviously has a noticeable effect on moccasin production costs.

With mechanical stretching, the quality of the operation leaves a lot to be desired. A large number of the ruffles and wrinkles are crushed rather than stretched and, furthermore, the action of the hammer that goes from one lateral extremity towards the apex of the vamp, tends to "off center" the toe cap with respect to the vamp in a way that is irremediable.

Another problem with mechanical stretching is in consequence of the fact that, in some cases, the hammering spoils the apex of the vamp (namely the curved front extremity thereof) that, appearance wise, is the most refined part of the whole moccasin.

SUMMARY OF THE INVENTION

The object of the invention is to make available a process with which to implement the stretching operation on moccasins in a way that is uniform over the full area of the skin subjected to stretching, with a constant stretching pressure being exercised on the said area.

A further object of the invention is to make available for the implementation of the said process, a device that is universal, in other words, suitable for any type of moccasin without having to resort to particular modifications in the structural conformation of the said device.

Yet another object of the invention is to make available a device which, besides satisfying the preceding object, is simple to make and of a limited cost compared to the service provided there with.

The foregoing objects are achieved with the process according to the invention for stretching the vamp of mocassins whose upper front edge is stitched to a corresponding toe cap, wherein the utilization is envisaged of a last, kept at a predetermined temperature, on which the toe capped vamp is placed taut, the said process being characterized by the fact that the said stretching operation is defined by a cyclic succession of a plurality of identical elementary phases, through each of which the part of the skin subjected to stretching is gradually wound from one extremity to the other, and vice versa, at a speed that can be set, by means of a continuous or discrete surface that exercises an adjustable pressure thereon.

A device with which the process can be carried out comprises: a flexible netted container housing spherical objects, the meshes in the said net being so sized as to allow a numerically equivalent number of the spherical objects to be inserted therein without it being possible for the said spherical objects to escape from the container; a support, to which the said container is hung, positioned above the said last and given reciprocating rectilineal motion so that the said container may come into flush contact with the vamp taut on the said last; elastic elements enshrouding laterally, in a skin tight fashion, the said container, and destined to exert a predetermined inward directed pressure on the said spherical objects; and means that exert an effect on the bottom end of the said container, destined to define in the said end, an adjustable depth lip able to receive the apex of the vamp.

BRIEF DESCRIPTION OF THE DRAWINGS

Emphasis is given hereinafter to the characteristics of the invention, with reference to the accompanying table of drawings, in which.

DESCRIPTION OF THE PREFERRED EMBODIMENT

Figures 1, 2, 3, 4, 5:
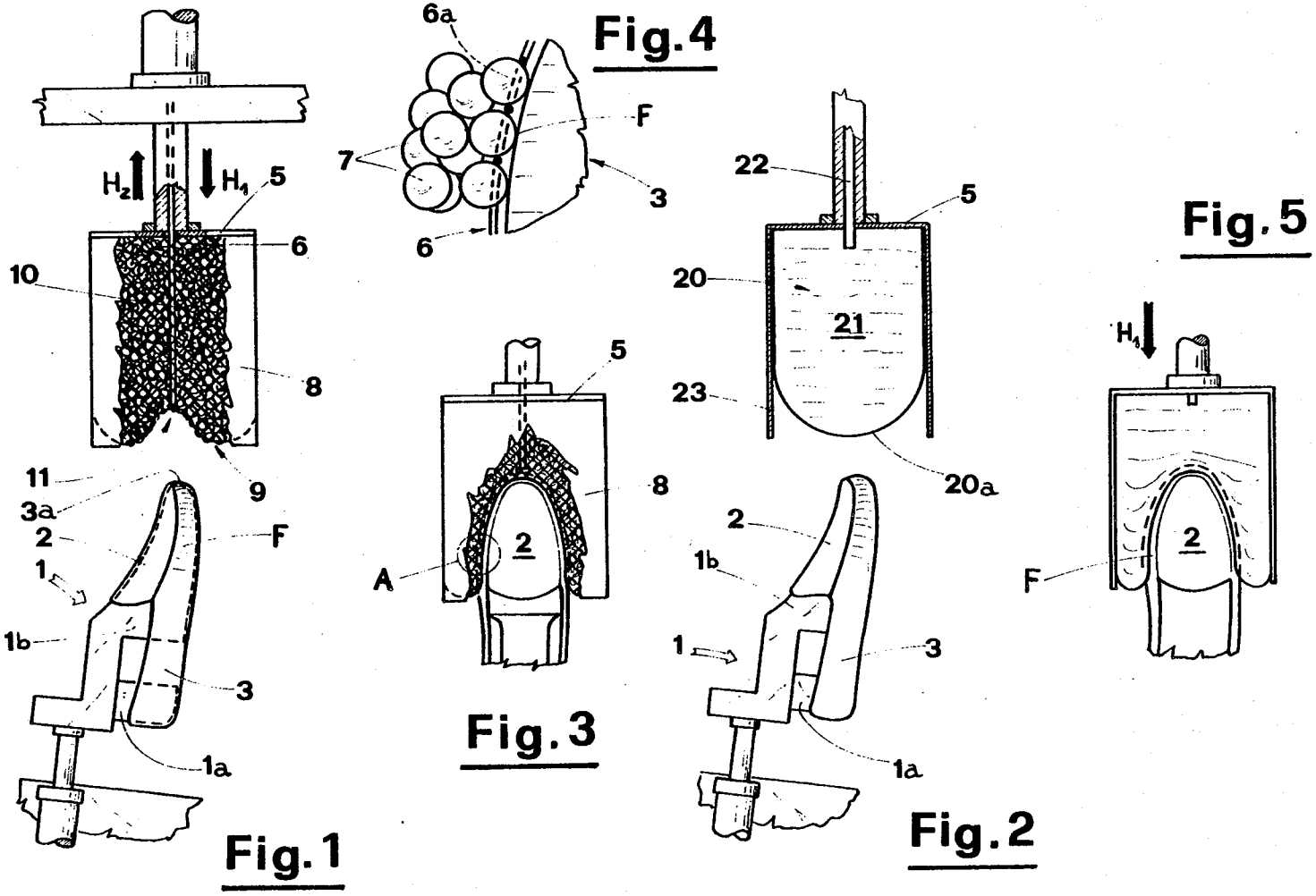
FIGS. 1 and 2 each show, in a lateral diagrammatic view, one embodiment for the device according to the invention.
FIG. 3 shows, in a lateral diagrammatic sectional view, the device depicted in FIG. 1 at the time the front sides of the vamp are being stretched.
FIG. 4 shows, in an enlarged scale, the detail A in FIG. 3.
FIG. 5 shows, in a lateral diagrammatic sectional view, the device depicted in FIG. 2 at the time the front sides of the vamp are being stretched.

With reference to FIGS. 1, 3 and 4, shown at 1 is a shoe last constituted, as is known, by two parts 1*a* and 1*b* movable through known systems, one with respect to the other. The said last is kept, by means of known heating systems (for example, an electric resistance, steam etcetera), at a predetermined temperature in such a way as to soften the skin placed taut on the said last, consisting of the vamp 3 and the toe cap 2.

Placed above the last 1 is a support 5 that is given vertical reciprocating motion, in the directions H1 and H2, through known means (for exaple, a jack). To the support 5 is hung a netted container 6 housing a plurality of spherical metal objects 7.

The meshes 6*a* of the said net are so sized as to allow the spherical objects 7 to protrude there from but not escape (see the enlarged detail A in FIG. 3). The lateral surface of the container 6 is tightly banded by an elastic 8 that does not touch the bottom end 9 of of the contaniner. The said end is hooked to an upward oriented wire 10 anchored (in a non-illustrated known fashion) to the support 5. The function of the wire is to define, in the said end, a lip 11 whose depth can be adjusted continuously depending on the lifting of the wire.

A description will now be given of the operation of the above described device.

Prior to setting the said device in operation, it is necessary for the depth of the lip 11 to be adjusted. This depends on the type of skin used for the vamp and on the degree of stretching the operative wishes the apex 3*a* of the vamp to undergo. In the sides F of the vamp, as a consequence of the stitching of the vamp to the toe cap 2, there are prevalently transversely extending ruffles and wrinkles. The device has the task of flattening, by stretching, the said ruffles and wrinkles, with use also being made of the action of the heat (coming forth from the heated last) that renders the skin soft.

The descent of the support 5 (direction H1) carries the bottom end 9 of the container 6 flush up against the vamp 3 with the result that this is gradually enshrouded by the container on account of the fact that the said container is constituted by a net filled with spherical objects and that, on one hand, the elastic 8 prevents the container from expanding outwards and, on the other, exercises an inward directed pressure on the spherical objects. In this way, the speherical objects situated in a position facing the vamp and protruding from the meshes in the net, first of all make contact with the skin of the vamp and, with the continuation of the descent and with the subsequent ascent of the support 5, roll over and/or rub the said skin, applying suitable pressure.

Recapitulating, there is a contemporaneous action on the part of a number of spherical objects which, from the top downwards (direction H1), and subsequently from the bottom upwards (direction H2) exert an action of compression on the skin which, as the above mentioned elementary phases (descent and subsequent ascent) are repeated, is consequentely stretched little by little.

It is obvious that the weight of the container 6, the relative vertical reciprocating motion speed and the pressure exerted by the elastic 8, are all elements that play a part, as does also the number of elementary phases, in rendering the stretching operation optimal.

The deeper the lip 11, the less efficient is the stretching action of the device in question on the apex 3*a* of the vamp.

The advantages of what has just been stated are apparent to experts in the field concerned.

An alternative to the previously described embodiment is illustrated in FIGS. 2 and 5.

Shown at 20 in the said figures is a diaphragm that can be deformed elastically. This hangs from the support 5 and there with defines a chamber 21 into which is sent, under pressure, (through, for example, a pipe 22 provided in the rod of the jack that moves the support 5), a suitable fluid (such as air or water) possibly heated to a predetermined temperature. The diaphragm 20 is prevented from expanding outwards since it is restrained by a tubular element 23 fixed to the top of the support 5.

With the descent of the support 5 (direction H1), the end 20*a* of the diaphragm is carried into contact with the vamp 3 which, little by little, is tightly enshrouded by the said diaphragm since this is able to undergo an alteration in shape and, furthermore, is subjected to the pressure of the fluid contained therein.

In this way, on the vamp is exerted a suitable pressure which, jointly with the action of the heat given to the vamp by the last 1 and possibly by the said fluid, and as the elementary phases (descend and subsequent ascent of the diaphragm) are repeated, consequently stretches the skin.

It is emphasized that the stretching action is influenced positively by the (adjustable) pressure applied to the vamp by the diaphragm, as well as by the temperature of the fluid in the chamber 21.

The notable advantage the device according to the invention offers in both embodiments is due to the fact that the stretching action takes place contemporaneously on both of the sides F (thereby not causing the toe cap to be, in any way, off-centered) in a way that is gentle and gradual like a hypothetical massage: this prevents the ruffles and wrinkles from getting dented and crushed.

Stress is also laid on the fact that the action taken by the device on the toe cap stitched to the vamp is extremely advantageous since it tends to close the pores in the skin used for the toe capped vamp.

In the first embodiment, the heating of the spherical objects (either through contact with the skin, in turn heated by the last, or by means of systems known to experts in the field concerned) constitutes a positive factor since it tends to render the skin even softer, to the benefit of the stretching operation.

Emphasis is also laid on the extreme simplicity of the device forming the subject of the invention, and on the important results achieved there with (of a practical, functional, reliability etcetera nature).

It follows from what has been stated above that with the said device, the process for stretching the vamp of mocassins is implemented in a way clearly dissimilar to that adopted in the processes known to date. With the process described herein, the stretching process is defined by a cyclic succession of a plurality of identical elementary phases, through each of which the part of the skin subjected to stretching is gradually wound from one extremity to the other, and vice versa, at a speed that can be set, by means of a continuous or discrete surface that exercises an adjustable pressure thereon.

The continuous type contrast surface is formed by means of the said diaphragm 20 (2nd embodiment of the invention), while the discrete contrast surface is created through the said spherical objects 7 (1st form of embodiment).

It is understood that the foregoing description has been given as an unlimited example and thus that variations to the process as described above and/or variations in the construction of the device with which the said process is implemented (for example, in place of the elastic 8, use can be made of an air filled tube that wraps laterally around the container ad exerts, depending on the type of skin, an adjustable degree of pressure) fall within the framework of protection afforded to the invention as claimed hereinafter.

What is claimed is:

1. A process for stretching the vamp of a moccasin to which is stitched a toe cap at the upper front edge, comprising placing said vamp and toe cap on an expandible last and expanding and heating said vamp to be taut and heated to a predetermined temperature; bringing said vamp and toe cap into and out of contact with a plurality of independently movable spherical objects, according to a cyclic succession of phases, said spherical objects being freely contained inside a flexible mesh with said mesh bound by an elastic element that is able to exert on said spherical objects an inward pressure, each said spherical object pressing, rolling and rubbing independently on said vamp and toe cap.

2. A process for stretching the vamp of a moccasin to which is stitched a toe cap at the upper front edge comprising: placing said vamp and toe cap on an expandible last, expanding said last to render taut said vamp, heating said vamp and toe cap to a predetermined temperature, bringing an elastic diaphragm into contact with said vamp and toe cap and pushing said diaphragm against said vamp and toe cap under gradual and successive pressure to wrap around and press on said vamp and toe cap according to a cyclic succession of phases and removing said diaphragm from the vamp and toe cap.

* * * * *